US005709275A

United States Patent [19]

Neumaier

[11] Patent Number: 5,709,275

[45] Date of Patent: Jan. 20, 1998

[54] SCREW-DRIVING TOOL

[75] Inventor: Anton Neumaier, Fürstenfeldbruck, Germany

[73] Assignee: Hilti Aktiengesellschaft, Furstentum, Liechtenstein

[21] Appl. No.: 690,171

[22] Filed: Sep. 30, 1996

[30] Foreign Application Priority Data

Jul. 26, 1995 [DE] Germany ..... 195 27 193.9

[51] Int. Cl.[6] ..... B25B 23/157

[52] U.S. Cl. ..... 173/13; 173/178

[58] Field of Search ..... 173/13, 176, 178, 173/15, 205, 124, 104, 216, 217

[56] References Cited

U.S. PATENT DOCUMENTS

| | | | |
|---|---|---|---|
| 4,480,699 | 11/1984 | Elmer | 173/176 |
| 5,054,588 | 10/1991 | Thorp et al. | 173/178 |
| 5,156,244 | 10/1992 | Pyles et al. | 173/178 |

FOREIGN PATENT DOCUMENTS

| | | |
|---|---|---|
| 0498191 | 1/1951 | Belgium . |
| 0195853 | 12/1985 | European Pat. Off. . |
| 0476999 | 9/1991 | European Pat. Off. . |
| 0532289 | 9/1991 | European Pat. Off. . |
| 3818924 | 12/1987 | Germany . |
| 4333599 | 10/1992 | Germany . |

*Primary Examiner*—Joseph J. Hail, III
*Assistant Examiner*—Jay A. Stelacone
*Attorney, Agent, or Firm*—Anderson Kill & Olick, P.C.

[57] ABSTRACT

A screw driving tool includes a housing (1) containing a motor (2), and an axially fixed drive pinion (3) powered by the motor. An axially extending spindle (5) is mounted in the housing (1) and is axially displaceable against the force of a spring (4) relative to the drive pinion and a ball shaped clutch element (6) positioned between the drive pinion and the spindle and cooperating with stop faces on the drive pinion and spindle. The clutch element (6) can be disengaged from the drive pinion and is axially displaceable and rotatable to a limited extent relative to the spindle (5).

7 Claims, 2 Drawing Sheets

SCREW-DRIVING TOOL

BACKGROUND OF THE INVENTION

The present invention is directed to a manually operable tool, such as a screw driving tool having a housing, a motor located in the housing, a motor driven drive pinion fixed axially in the housing and a spindle supported in the housing and axially displaceable relative to the drive pinion against the force of a spring. A clutch element is located between the drive pinion and the spindle so that the clutch element can be disengaged from the spindle as well as being axially displaceable and rotatable, both to a limited extent, relative to the spindle.

Electrically powered screw driving tools with a disengageable clutch located between a spindle and a drive pinion are used for installing surface flush or counter sunk screws. The disengageable clutch enables an automatic, noise and wear free disengagement of the spindle from the drive pinion after the desired screw driving depth has been reached.

A screw driving tool with a clutch is disclosed in EU-PS 0 195 853 and includes a motor driven first clutch part, a axially displaceable second clutch part rotationally supported in the housing of the tool and a third clutch part axially displaceable against the force of a spring as well as being provided with a limited degree of rotation in the circumferential direction. The first clutch part is formed by a drive pinion with teeth projecting in the driving direction. The second clutch part is formed by a spindle with teeth projecting counter to the driving direction, and the third clutch part is formed by a clutch element provided on both sides with teeth. If the screw driving tool is pressed against a receiving material, that is, the material into which the screw is to be driven, the spindle is axially displaced against the force of the spring with the interposition of the clutch element, whereby all of the teeth interengage in a positive locking manner. If torque is transmitted from the drive pinion to the spindle, the clutch element is rotated and displaced axially relative to the spindle. This position of the clutch element relative to the spindle is maintained until the spindle is displaced in the driving direction after completion of the screw driving operation, until the positive locked connection between the teeth of the drive pinion and the clutch element has been terminated.

The known clutch can be fabricated only at great expense because the large teeth as well as the high weight of the parts have a negative effect on the overall weight of the screw driving tool, so that the tool operator quickly experiences tiredness when working with such a tool. In addition, the known tool is prone to great wear.

SUMMARY OF THE INVENTION

Therefore, the primary object of the present invention is to provide a clutch for a manually operated tool which can be manufactured economically and is distinguished by having a low weight and low wear.

In accordance with the present invention, the clutch element is a ball which cooperates with stop faces on the drive pinion and the spindle.

In the present invention, the clutch element enables an economical manufacture of the manually operable tool, since the ball is a commercially available item which can be easily purchased, the stop faces cooperating with the ball can be placed directly on the spindle and the drive pinion. A further advantage is the small size of the clutch element and its low weight affording a positive effect on the overall weight of the manually operable tool.

The stop face of the drive pinion is preferably formed by at least one recess in the inside surface of the drive pinion extending parallel to the axial direction of the spindle. Due to the arrangement of the stop faces inside the drive pinion, the axial length of the drive pinion and the overall length of the manually operated tool can be kept small.

Preferably, the stop face on the spindle is formed by a groove located in an outer circumferential surface of the spindle with at least the extent of the groove in the circumferential direction exceeding the corresponding extent of the ball-shaped clutch element.

Stop faces in the shape of a groove or recess have the advantage that they can be formed economically and do not project beyond the outside surface of the spindle. Because of the special arrangement of the groove, the spindle can be turned to a limited extent relative to the drive pinion when the clutch is engaged.

For affording an axial displacement of the spindle relative to the drive pinion, if both parts are turned towards one another, the stop face of the spindle, facing opposite to the driving direction of the tool, is preferably formed by an edge which is inclined relative to a plane running perpendicularly to the spindle axis.

To obtain an axial displacement of the spindle relative to the drive pinion, not affected by the rotational direction through which the two parts are turned against each other, advantageously the edge runs inclined counter to the setting direction of the two circumferential ends of the groove.

Preferably, the spring is located between the clutch element shaped as a ball and the drive pinion, so that it does not impair the function of the spring. In this way the spring is disposed between two rotating parts. If the spring is located between a rotating part and a part unable to rotate relative to the housing, a functional disturbance is set up as soon as the rotating part is turned, and friction is generated between the spring and one of the parts. The frictional force causes torsional loads which act upon the spring and have a negative effect on the function of the tool. A ring disposed on the spindle and displaceable axially relative to it, is preferably arranged between the ball and the spring. Accordingly, the force of the spring is passed onto the ball perpendicularly to the axis of the spindle and also transmits the entire force of the spring to the ball. The ring also enables the alignment of several balls, so that they snap in simultaneously into several depressions in the drive pinion and, after the screw driving operation has been completed, are moved simultaneously into their original position when the manually operated tool is removed from surface of the receiving material.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
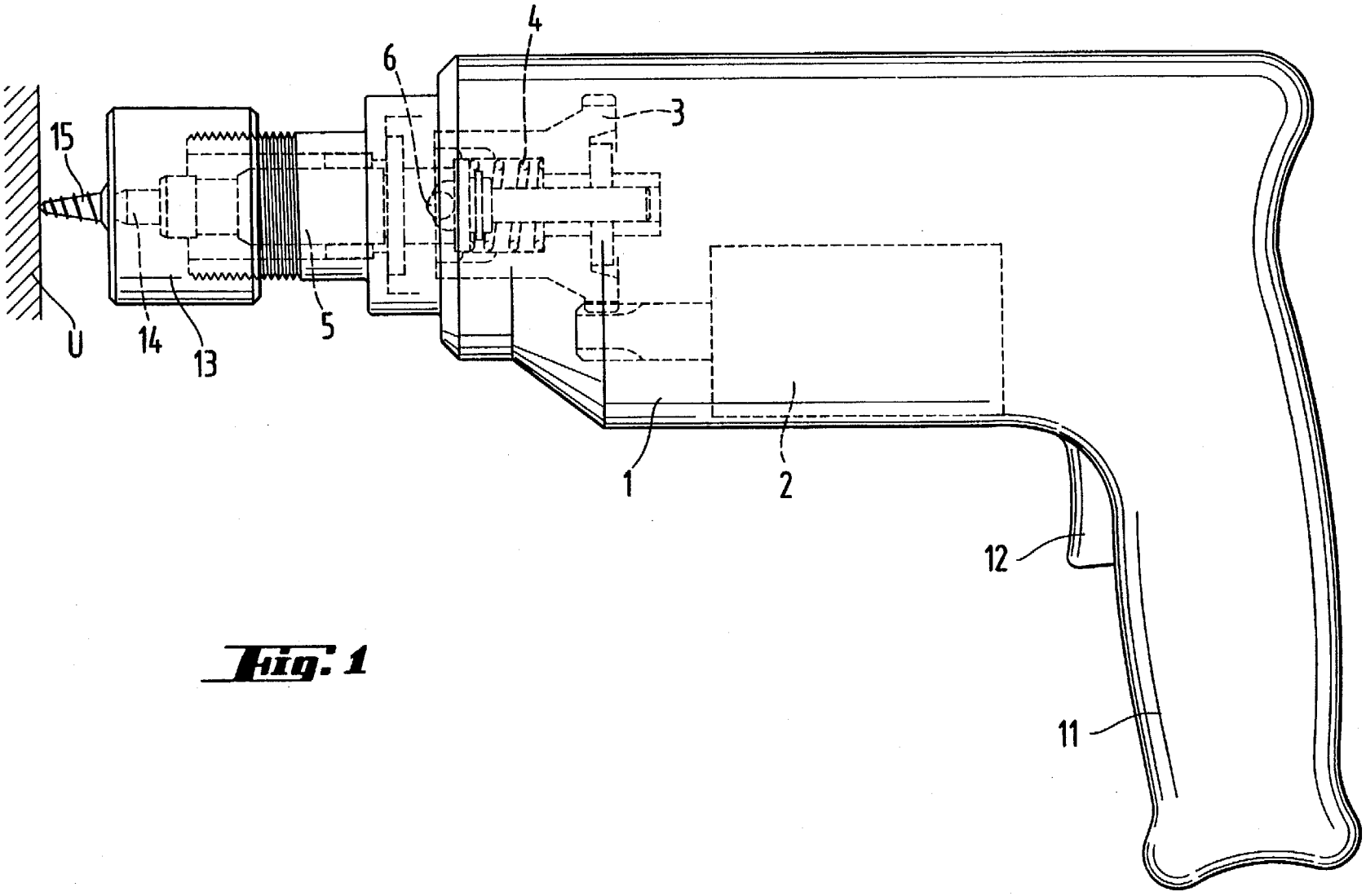
FIG. 1 is an elevational view showing the manually operated tool of the present invention.
Figure 2:
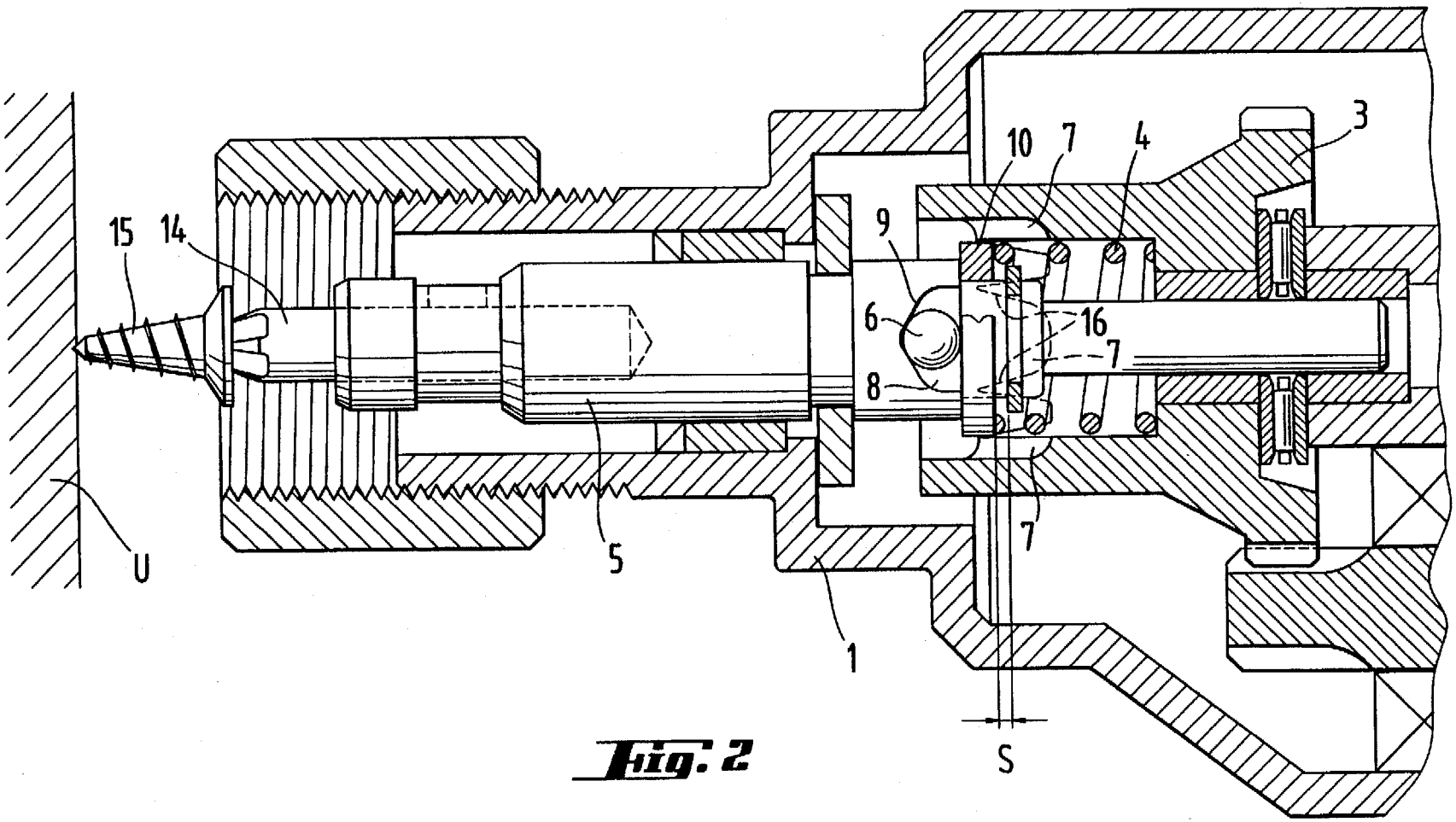
FIG. 2 is a leading end portion of the manually operated tool shown in FIG. 1 in an enlarged and sectioned view.

In FIGS. 1 and 2 a screw driving tool is shown having a housing 1 with a leading end at its left end as viewed in FIG. 1 and a trailing end at its right end. The driving direction of the tool is from the trailing end toward the leading end and the axial direction of the parts are in the same direction. At its trailing end, the housing 1 has a handle with a trigger-like actuating switch 12. At its leading end, the housing 1 has an adjustable depth stop 13 and contains an axially extending spindle 5 axially displaceable against the force of a spring 4.

As shown in FIG. 2, a motor 2, note FIG. 1, drives a drive pinion 3, a ball shaped clutch element 6 and the axially displaceable spindle 5 are also located in the housing. The spring 4 and a ring 10 adjacent to the ball are disposed on the spindle 5, so that they can be displaced to a limited extent in the axial direction of the spindle. A groove 8 is located on an outside circumferentially extending surface of the spindle 5 and the dimension of the groove measured in the circumferential direction is greater than the corresponding dimension of the ball. Groove 8 has a stop surface in the form of an edge 9 facing opposite to the driving direction and the edge runs inclined to a plane extending perpendicularly to the spindle. The edge 9 is arranged inclined to the circumferentially spaced ends of the groove 8. A recess 7 is located opposite to the groove 8 in an inner circumferentially extending surface of the drive pinion 3. The recess 7 extends inwardly generally parallel to the axial direction of the spindle 5 and having a depth extending in the axial direction of the spindle. The recess 7 has two stop edges 16 approaching one another opposite to the driving direction. The groove 8 and the recess 7 accommodate the ball 6. The groove 8 and/or the recess 7 in the drive pinion 3 are arranged in such that an axial and circumferential movement of the spindle 5 relative to the drive pinion 3 is possible through a predetermined axial dimension S. The recess 7 has a constant depth in the radial direction.

The leading end face of the spindle is arranged to receive a bit 14 for driving a screw 15. The spindle 5 and the ball 6 are displaced by the screw 15 on the bit 14 by pressing the screw driving tool against a receiving material U against the action of the spring 4. In this displacement of the spindle, the ball 6 engages in the recess 7 in the drive pinion, so that the pinion and the spindle are connected together for rotation in a positively locked manner. At this point the spring 4 is prestressed. When the screw driving tool is placed in operation, the spindle rotates. When the ball 6 is moved into the groove 8 in the spindle 5, a displacement of the spindle 5 occurs relative to the drive pinion 3 in the circumferential and axial directions.

The screw 15 is driven by the screw driving tool until the depth stop 13 bears against the receiving material U. Subsequently, the spring 4 causes the spindle 5 to continue to rotate until the driving depth set by the depth stop 13 has been reached, and the ball 6 no longer seats in the recess 7, whereby the rotationally rigid locked connection between the spindle 5 and the drive pinion 3 is interrupted. Then the spring 4 moves ring 10 disposed between the ball and the spring 4 and axially displaceable upon the spindle 5 into the initial position. As a result, the axial displacement and rotation between the spindle 5 and the drive pinion is terminated. The displacement and rotation had taken place during cooperation between the ball and the groove 8 on the spindle 5.

After the screw driving tool has been turned off and removed from the receiving material U, the spindle 5 moves the spring 4 and the spindle into their initial positions.

While specific embodiments of the invention have been shown and described in detail to illustrate the inventive principles, it will be understood that the invention may be embodied otherwise without departing from such principles.

I claim:

1. A manually operable screw driving tool, comprises a housing (1), said housing having a leading end a trailing end and an axially extending driving direction extending in trailing end—leading end direction, a motor (2) mounted in said housing (1), a drive pinion (3) located in said housing and powered by said motor, said drive pinion (3) being axially fixed in said housing, an axially extending spindle (5) located in said housing and being axially displaceable relative to said drive pinion (3) against a force of a spring (4), a clutch element (6) positioned in said spindle and engageable between said drive pinion (3) and said spindle (5) for driving said spindle, said clutch element (6) being disengageable from said drive pinion (3) and being axially displaceable and rotatable relative to said spindle (5) to a limited extent, and said clutch element (6) being a ball having a diameter cooperating with at least one stop face on each of said drive pinion and said spindle.

2. A manually operable tool, as set forth in claim 1, wherein said at least one stop face of said drive pinion being formed by a recess (7) formed in an interior circumferential surface of said drive pinion (3) and having a depth extending parallel to the axial direction of said spindle (5).

3. A manually operable tool, as set forth in claim 1 or 2, wherein said at least one stop face on said spindle being formed by a groove (8) located at an outer circumferential surface of the spindle and said groove (8) having a dimension measured in the circumferential direction exceeding the diameter of said ball.

4. A manually operable tool, as set forth in claim 3, wherein said at least one stop face of said spindle (5) facing opposite to the driving direction is formed by an edge (9) inclined to a plane extending perpendicularly to the spindle axis.

5. A manually operable tool, as set forth in claim 4, wherein said edge (9) runs at an inclination outwardly opposite to the driving a direction relative to circumferential ends of said groove.

6. A manually operable tool according to any of claims 1 or 2, wherein said spring (4) is disposed between said ball and said drive pinion (3).

7. A manually operable tool, as set forth in claim 6, wherein a ring (10) is located on said spindle (5) between said ball (6) and said spring (4) and being arranged to be displaceable to a limited extent in the axial direction of said spindle (5).

* * * * *

UNITED STATES PATENT AND TRADEMARK OFFICE

CERTIFICATE OF CORRECTION

PATENT NO. : 5,709,275

DATED : January 20, 1998

INVENTOR(S) : Anton Neumaier

It is certified that error appears in the above-identified patent and that said Letters Patent is hereby corrected as shown below:

On the title page, item [73] should read:

[73] Assignee: Hilti Aktiengesellschaft,
Schaan, Fürstentum Liechtenstein

Signed and Sealed this

Fourteenth Day of April, 1998

Bruce Lehman

*Attest:*

BRUCE LEHMAN

*Attesting Officer*

*Commissioner of Patents and Trademarks*